US005803885A

United States Patent [19]

Tiller

[11] Patent Number: 5,803,885

[45] Date of Patent: Sep. 8, 1998

[54] EXERCISER FOR ROCKING A WHEELCHAIR

[76] Inventor: Howard M. Tiller, 202 Galvin Rd., Bellevue, Nebr. 68005

[21] Appl. No.: 498,081

[22] Filed: Jul. 5, 1995

[51] Int. Cl.[6] ..... A63B 26/00

[52] U.S. Cl. ..... 482/146; 482/904

[58] Field of Search ..... 601/24, 26, 23; 482/904, 14

[56] References Cited

U.S. PATENT DOCUMENTS

| | | | |
|---|---|---|---|
| 4,768,497 | 9/1988 | Winge | 602/24 |
| 4,869,494 | 9/1989 | Lambert, Sr. | 482/57 |
| 4,911,435 | 3/1990 | Johns | 482/904 |
| 5,249,640 | 10/1993 | Grove | 602/24 |

*Primary Examiner*—Lynne A. Reichard

[57] ABSTRACT

A standing support bar with adjustable heights is provided in front of the wheelchair so that the operator/patient can stand with safety. Foot rests fixed to the frame cause a flexing of the legs of the patient. A safety post fixed to the platform prevents excessive rearward tilting of a chair preventing the capsizing of a patient. The head rest is fixed to the rocking platform for supporting the patients head during rocking. A special addition to the power mechanism for rocking the wheelchair is provided with stop means for causing the platform to come to rest in a position convenient for the rolling of the wheelchair down from the platform. The pivoting ramp in the front of the platform maintains the gap, bringing the platform and the frame there beneath closed for safety during rocking.

8 Claims, 2 Drawing Sheets

EXERCISER FOR ROCKING A WHEELCHAIR

FIELD OF THE INVENTION

This invention is in the field of exercisers for stimulating the circulation of the blood and exercising the muscles of patients. Particularly it is in the field of devices accomplishing a rocking motion of the patient. Still more particularly the next exercisers that will exercise the patient who is supported in a wheelchair and causing the wheelchair to rock.

BACKGROUND

In the prior art many devices have been proposed. One is a U.S. Pat. No. 3,351,051, issued No. 7, 1967, to J. A. Jennings, entitled treatment table with rocking means. In this patent the patient lies completely down on his back or chest on a platform. The platform is then rocked by mechanical means.

A somewhat close in similarity in one sense is the U.S. Pat. No. 3,653,080, issued Apr. 4, 1972, to Robert X. Hafele, entitled rocking infant seat. In this patent a seat for an infant is caused to rock by means of a motor having a Pittman action, causing the rotation of the motor to deliver a reciprocating motion to tilt the baby seat.

By far the closest of the older patents believed to be the U.S. Pat. No. 4,768,497, issued Sep. 6, 1988, to Donald J. Winge, entitled rocking platform for wheelchairs. In this patent a wheelchair is supported on a platform which is caused to rock back and forth by a Pittman action and a ramp used also to guide the wheelchair up onto the platform has a double purpose of being cause to assume the position, locking the wheels of the wheelchair so that they cannot go forward off of a platform in an unwanted manner.

The disadvantage of the device used to keep the wheelchair rolling off of the front of the platform is that it leaves a gap between the front end of the platform and the bottom of the frame of the device so that there is a danger that a person might accidently put their foot into the position under the front of the platform, whereby it could be crushed by the down motion of the platform.

A particular disadvantage of this patent and all of the other patents mentioned is that it only accomplishes the rocking motion for the wheelchair and has no other exercising functions.

OBJECTIVES

One of the objectives hereof is to provide a safe way to hold the wheelchair on the platform, preventing it from rolling forward and yet permitting a ramp at the forward end of the platform to serve its function of blocking the gap between the front edge of the platform and the frame beneath so that the foot of a person cannot accidently get in between the platform and the frame, to prevent the crushing, accidently, of a person's feet.

Another objective is to provide support at the right and left sides of the wheelchair platform. The support being fixed to the frame so as to be suitable for gripping by the patient, so as to stabilize himself in order to avoid fear at times when the rocking motion has begun. This is important because the sort of patients that use a rocking wheelchair exerciser will many of them be extremely invalid and easily frightened. Another objective is to provide arm and shoulder exercise in the manner of arm motion involved in rowing. This is done by providing means for the operator to grip stationary grip places attached to the frame so that as the chair moves back and forth the hands will remain stationary, causing the elbows to flex.

Still another objective is to provide special foot rests which are affixed to the frame and are used during the rocking and at times when the foot rests of the wheelchair are swung out of position so they do not interfere. The special foot rests, being fixed to the frame hold the feet stationary so that during the rocking the knees will flex. With the foot rest engaged, the ankle, knee, hip joints and leg muscles are exercised.

This gives lower body exercise. The head rest supports weak neck muscles and allows relaxation and comfort. Another objective is to provide an exercise support bar in a convenient position for grip by the wheelchair patient for use during wheelchair rocking if desired or for use to exercise against even while the wheelchair is not being rocked. A further objective is to provide a standing support bar disposed far enough in front of the wheelchair so that the patient can stand up in front of the wheelchair, holding on to the standing support bar, there being also provided enough space on the platform in front of the wheelchair on which the patient can stand.

Still another objective is to provide for the standing support bar to be positionable at various heights for the convenience of persons of different sizes, this same variable positioning making it possible to use the same bar in different positions as the exercise support bar or as the standing support bar. In other words it can be used while sitting or standing by simply putting it in various adjusted positions of varying heights. Another objective is to provide a safety post attached to the platform and extending upwardly sufficient to prevent any accidental rearward tipping of the wheelchair. Prolonged periods of immobility cause extensive body changes that are very harmful to the health and well being to the confined person. The major organs then suffer physiologic and biochemical changes. The consequences of these changes are poor health, need for more extensive care, and great cost.

The problems that can come from immobility of the body are:

1. Inefficient oxygen intake.
2. Lower respiratory tract infection.
3. Pneumonia.
4. Tracheobronchitis.
5. Impaired immune system.
6. Poor circulation of blood and body fluids.
7. Loss of bone calcium.
8. Permanent fixation of joints so they will no longer flex.
9. Loss of muscle tone.
10. Poor elimination and the problems therefrom.

DESCRIPTION OF THE PREFERRED EMBODIMENT

Figure 1:
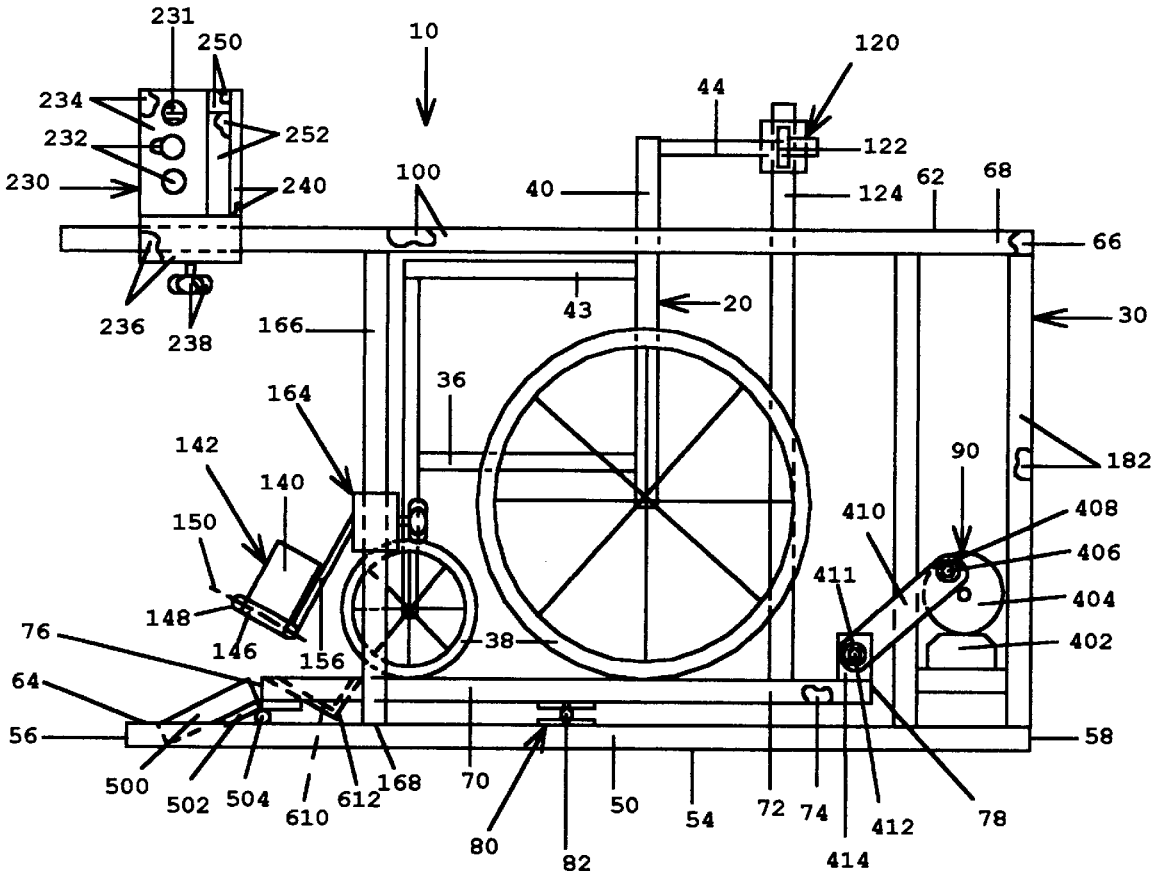
FIG. 1 is a right side elevation of the exerciser hereof showing the platform in an intermediate position. Parts are broken away to reveal other duplicate parts therebehind as the right and left sides of the exerciser are duplicates.

The wheelchair rocker and wheelchair combination hereof is generally shown at 10 in FIG. 1 and has a wheelchair 20 supported by a wheelchair rocker 30. The wheelchair 20 is a common type in that it has a normally horizontal seat 36, and wheels 38, a seat back 40, and armrests 43, and rearwardly projecting handles 44.

Such chairs have common footrests which are not shown herein, as they are removed and a stationary footrest system hereof, later described, is used instead.

The rocker or wheelchair rocker 30 has a frame 50 having undersurfaces 54 adapting the frame to be in an exerciser operating position when the frame is rested on a horizontal surface. The frame 50 has forward and rearward ends 56 and 58 and has upper and lower sides 62 and 64, and right and left sides 66 and 68. A rocking platform 70 on the frame 50 is large enough to receive a common wheelchair thereon.

The platform 70 has right and left sides 72 and 74 and forward and rearward ends 76 and 78. A pivot assembly 80 mounts the platform 70 on the frame 50 for the rocking of the platform 70 at a midsection of the platform 70 about horizontal right-to-left axis 82.

A platform driving assembly 90 is mounted on the frame 50 and is connected to the platform 70 and causes the platform 70 to tilt up and down at its forward end about the axis 82.

Right and left supports or support bars 100 are provided and can be gripped by a patient's hands, preferred, instead of upright handles, later described, for assurance of stability. The supports 100 are located at right and left sides of the platform each at a height to be gripped while the patient is sitting on a common wheelchair fixed to the platform 70 with the patient's forearms extended forwardly.

An anchoring assembly 120 has right and left sections 122 which are adapted to make a connection between the wheelchair handles 44 and a safety post 124 fixed to the platform 70 and moving therewith.

Right and left special foot rests 140 form parts of right and left footrest assemblies 142.

Each assembly 142 has its foot rest 140 mounted on a hinged connector 146 having a pivot member 148 about which the respective footrest 140 pivots on a forward-to-rearward axis 150, whereby the footrests can be horizontal or swing into vertical position so as to be out of the way when a patient is being put into the rocker 30. Or especially out of the way when the patient is rising to a standing position.

Each pivot member 148 is attached at its rearward side to an upwardly and rearwardly inclined pivot member connector 156.

The upper end of the pivot members 156 is attached to a vertically sliding footrest assembly attachment sleeve 164 which is adjustably positionable along a forward frame-post 166 which extends upwardly from a horizontal bottom frame section 168 to which it is attached.

The footrests 140 are long from left to right because they begin at the respective sleeve 164, and the sleeves 164 are each to a respective side of the platform 70.

The supports 100 are actually preferably support bars 100, each of which extend forwardly and rearwardly and horizontally.

The rearward ends of each support bar 100 are supported by a respective right or left rear frame post 182.

The great length of each grippable support bar 100 is useful because some people have shorter arms than others.

The safety post 124 is attached to the platform 70 and extends upwardly from it and can block rearward motion of the back 40 of the wheelchair 20 to prevent the capsizing of the wheelchair rearwardly.

A standing bar assembly 230 has a standing bar 231. The standing bar 231 is supported in pairs of vertically spaced right and left openings 232 in right and left standing bar posts 234 which extend upwardly from right and left standing bar sleeves 236, which latters are/slidable on respective support bars 100 and adjustably lockable thereon by right and left setscrews 238 through the standing bar sleeves 236.

Thus the standing bar 231 can be positioned at various heights and at various forward or rearward positions for persons of varying height and armlength.

Upright right and left handles 240 are provided for a patient's gripping to give a more secure feeling during rocking. The handles 240 are attached to the standing bar sleeves 236 and are attached at their upper ends to the standing bar posts 234 respectively, by right and left spacers 250 providing right and left open space 252 between the posts 234 and the handles 240.

Figure 2:
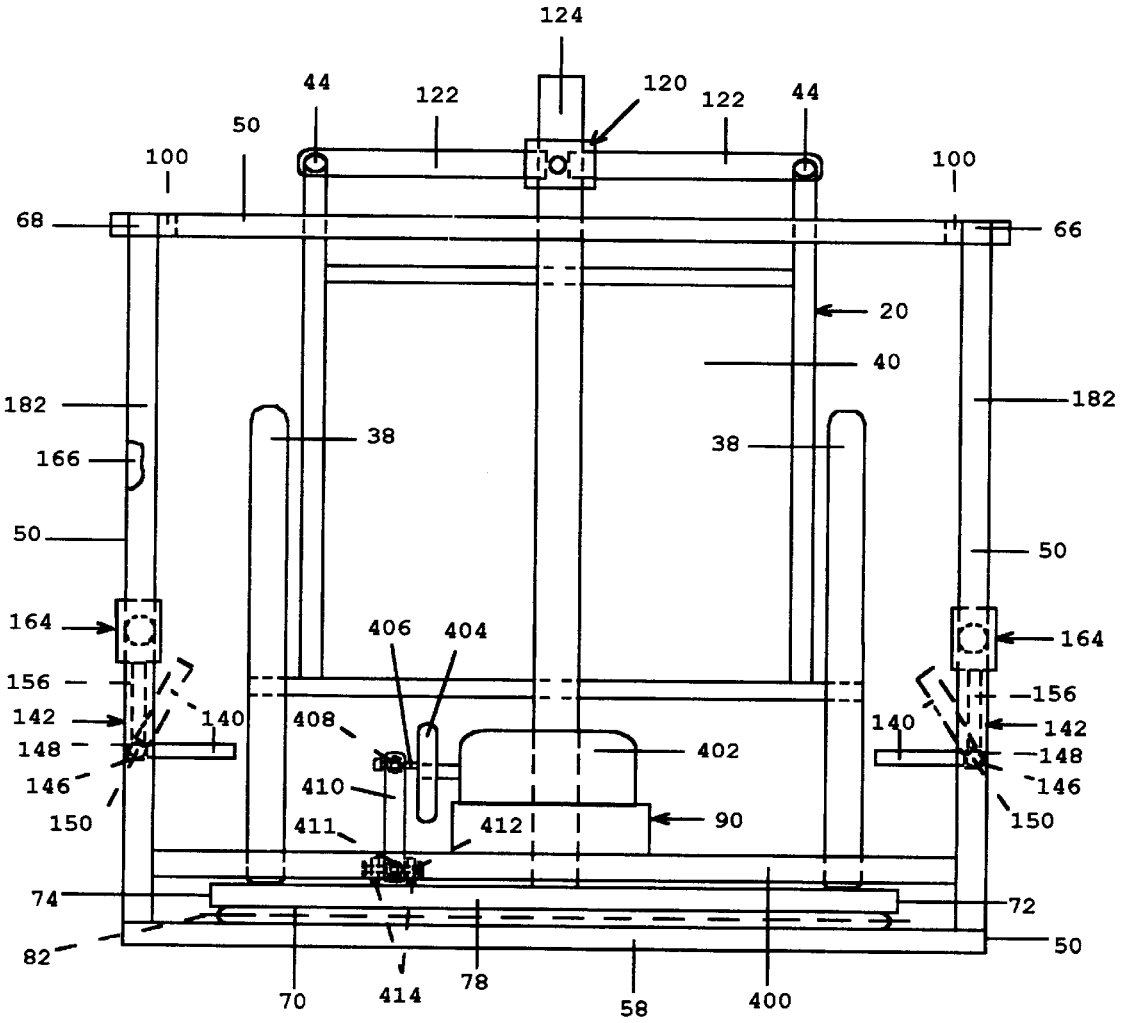
FIG. 2 is a rear elevation of the exerciser with the platform in the position of FIG. 1. Some parts are broken away to reveal parts in front thereof

In FIGS. 1 and 2, a platform rocking assembly or platform driving assembly 90 is shown hang a motor 402 driving a flywheel 404 to which a stubshaft 406 is eccentrically attached at an edge as seen in FIG. 1.

The stubshaft 406, receives a collar bearing 408 to which an arm 410 is attached connecting the collar bearing 408 to a final bearing 411 on a shaft 412.

The shaft 412 is supported by two spaced ears 414 fixed to the platform 70.

As best seen FIG. 1, the effect is to raise and lower the rearward end of the platform causing the wheelchair to rock.

In FIG. 1, a ramp 500 is hinged at 502 for pivoting about a horizontal axis 504 extending from left to right parallel to the ramp pivot axis 82. This causes the upper side of the ramp 500 to be parallel with the upper side of the platform 70 when the platform is at rest, for ease of ramping a wheelchair on.

But, when the forward end of the platform 70 is up, the ramp 70 will have pivoted into a position for blocking human feet, and objects, from getting under the forward end of the platform 70 causing ramp damage or crushing a person's foot.

In FIG. 1 a patient's standing recess 610 is provided. The recess 610 is at the forward end of the platform 70 and rearwardly of the ramp 500. The recess 610 has a bottom wall 612 that is horizontal at the time the platform 70 is stopped in the wheelchair loading and unloading position.

Wheelchair patients get very tired of sitting. It has been found that wheelchair patients find the opportunity to stand up, safely, with a standing bar to hold onto, is an opportunity that is a great blessing.

The standing recess 610 is in a position for being missed by the wheelchair wheels 38 during chair placement on the platform 70.

I claim:

1. An exercise device comprising:

a frame having a forward end, a rearward end, and right and left sides, said frame having a platform receiving section;

a platform above said platform receiving section, said platform having a forward end, a rearward end, and right and left sides;

a means for rotatably mounting said platform on said frame for rotation of said platform about a substantially horizontal platform axis, said platform axis being spaced substantially between said forward and rearward ends of said platform;

a power drive means interconnecting said platform and said frame for rotating said platform about said platform axis;

means for attaching a chair to said platform; and at least one exercise foot rest assembly attached to said frame substantially above the forward end of the platform so that when a chair is attached to the platform and a user is seated in the chair, the user can place his feet on the exercise foot rest assembly to exercise his legs when said platform is rotated about said platform axis.

2. The exercise device of claim 1 further comprising right and left arm rests attached to said frame on respective right and left sides of said platform so that when a chair is attached to the platform and a user is seated in the chair, the user can place his forearms on the arm rests to exercise his arms when said platform is rotated about said platform axis.

3. The exercise device of claim 2 wherein the power drive means comprises:

a power shaft, said power shaft rotating about a power shaft axis which is parallel to said platform axis;

means for rotatably attaching said drive shaft to said frame; and eccentric pivot means spaced from said drive shaft axis, an arm pivotally attached to said platform at a location spaced from said platform axis, wherein said eccentric pivot means attaches said drive shaft to said arm.

4. An exercise device comprising:

a frame having a forward end, a rearward end, and right and left sides, said frame having a platform receiving section;

a platform above said platform receiving section, said platform having a forward end, a rearward end, and right and left sides;

a means for rotatably mounting said platform on said frame for rotation of said platform about a substantially horizontal platform axis, said platform axis being spaced substantially between said forward and rearward ends of said platform;

a power drive means interconnecting said platform and said frame for rotating said platform about said platform axis;

means for attaching a chair to said platform; and right and left arm rests attached to said frame on respective right and left sides of said platform, so that when a chair is attached to the platform and a user is seated in the chair, the user can place his forearms on the arm rests to exercise his arms when said platform is rotated about said platform axis.

5. The exercise device of claim 1 having a forward hand grip means attached to said frame and positioned substantially above the forward end of said platform so that when a chair is attached to said platform and a user is seated in the chair, the user can grip said hand grip means with at least one of his hands to exercise his respective arm when said platform is rotated about said platform axis.

6. An exercise device comprising:

a frame having a forward end, a rearward end, and right and left sides, said frame having a platform receiving section;

a platform above said platform receiving section, said platform having a forward end, a rearward end, and right and left sides;

a means for rotatably mounting said platform on said frame for rotation of said platform about a substantially horizontal platform axis, said platform axis being spaced substantially between said forward and rearward ends of said platform;

a power drive means interconnecting said platform and said frame for rotating said platform about said platform axis;

means for attaching a chair to said platform; and a forward hand grip means attached to said frame and substantially positioned above the forward end of said platform so that when a chair is attached to said platform and a user is seated in the chair, the user can grip said hand grip means with at least one of his hands to exercise his respective arm when said platform is rotated about said platform axis.

7. The exercise device of claim 1 having a forward hand grip means attached to said frame and positioned substantially above the forward end of said platform so that when a chair is attached to said platform and a user is seated in the chair, the user can grip said hand grip means with at least one of his hands to exercise his respective arm when said platform is rotated about said platform axis.

8. The exercise device of claim 5 wherein said hand grip means is a bar means extending transversely of said platform from right to left completely across said platform.

* * * * *